US008037663B2

(12) United States Patent
Jensen

(10) Patent No.: US 8,037,663 B2
(45) Date of Patent: Oct. 18, 2011

(54) RETAIL BOXES AND METHOD OF MANUFACTURING RETAIL BOXES

(76) Inventor: Jarl Jensen, Nyack, NY (US)

( * ) Notice: Subject to any disclaimer, the term of this patent is extended or adjusted under 35 U.S.C. 154(b) by 64 days.

(21) Appl. No.: 12/463,883

(22) Filed: May 11, 2009

(65) Prior Publication Data

US 2010/0006628 A1 Jan. 14, 2010

Related U.S. Application Data

(60) Provisional application No. 61/080,237, filed on Jul. 12, 2008.

(51) Int. Cl.
*B65B 43/08* (2006.01)

(52) U.S. Cl. ..... 53/456; 53/461; 493/68; 493/102; 493/70

(58) Field of Classification Search ..... 53/456, 53/462, 461; 493/68, 69, 70, 78, 102, 62, 493/61

See application file for complete search history.

(56) References Cited

U.S. PATENT DOCUMENTS

| | | | | | |
|---|---|---|---|---|---|
| 2,332,652 | A | | 10/1943 | Mackenzie | |
| 3,330,715 | A | | 7/1967 | Terzuoli | |
| 3,342,322 | A | * | 9/1967 | Weisner et al. | 206/446 |
| 3,345,921 | A | | 10/1967 | Foss | |
| 3,370,777 | A | * | 2/1968 | Levi | 206/424 |
| 3,436,893 | A | | 4/1969 | Vokes et al. | |
| 3,486,612 | A | * | 12/1969 | Kivell | 206/320 |
| 3,543,994 | A | * | 12/1970 | Clark | 229/125.32 |
| 3,622,063 | A | * | 11/1971 | McVeigh | 229/122.23 |
| 3,981,758 | A | | 9/1976 | Thayer et al. | |
| 4,418,861 | A | | 12/1983 | McFarland et al. | |
| 4,461,137 | A | * | 7/1984 | Wood | 53/456 |
| 4,750,660 | A | | 6/1988 | Kamimura | |
| 4,802,421 | A | | 2/1989 | Atterby et al. | |
| 4,871,067 | A | * | 10/1989 | Valenti | 206/427 |
| 4,976,374 | A | * | 12/1990 | Macaluso | 229/122.26 |
| 5,201,461 | A | | 4/1993 | Sykora | |
| 5,333,779 | A | | 8/1994 | Skykora et al. | |
| 5,350,348 | A | | 9/1994 | Guot | |
| 6,029,884 | A | | 2/2000 | Roeland | |
| 6,499,655 | B1 | * | 12/2002 | Moen | 229/120.24 |
| 6,851,602 | B2 | | 2/2005 | Gosis et al. | |
| 7,069,856 | B2 | | 7/2006 | Hartka et al. | |
| 2008/0002011 | A1 | | 1/2008 | Mizutani et al. | |

OTHER PUBLICATIONS

International Search Report for PCT Application No. PCT/US09/50196, mailed Sep. 9, 2009, 4 pages.
Written Opinion for PCT Application No. PCT/US09/50196, mailed Sep. 9, 2009, 9 pages.
International Preliminary Report on Patentability for International Patent Application No. PCT/US2009/050196, mailed Apr. 21, 2011, 11 pages.

* cited by examiner

*Primary Examiner* — Sameh H. Tawfik
(74) *Attorney, Agent, or Firm* — Sheridan Ross P.C.

(57) ABSTRACT

The present disclosure is directed to a retail box and a method of making a retail box. Retail boxes in accordance with the present disclosure are manufactured beginning with paper, which is rolled on a core. Two halves of the box, or "half-boxes," are first produced, and then brought together to form a complete box.

20 Claims, 8 Drawing Sheets

RETAIL BOXES AND METHOD OF MANUFACTURING RETAIL BOXES

CROSS REFERENCE TO RELATED APPLICATIONS

This application claims the benefit of U.S. Provisional Patent Application Ser. No. 61/080,237 filed on Jul. 12, 2008, the entire disclosure of which is hereby incorporated herein by reference.

FIELD

The present disclosure is related to retail boxes and machinery and methods for making retail boxes.

BACKGROUND

Retail boxes are used widely by companies and individuals to package retail items for shipping to customers. Typically, the manufacture and assembly of a retail box is divided between two processes or machines that may be associated with different service providers or companies. Specifically, a retail box is first manufactured from raw materials, such as cardboard. This manufacturing process or step may occur using a dedicated machine that may be associated with a dedicated plant or company, which provides this service or manufacturing step. Secondly, the retail box is opened or assembled into a usable configuration. This step may be performed by a second dedicated machine, which may be located at a separate facility from the facility that had manufactured the retail box. This two-step process can lead to inefficiencies and added costs that may be born by companies or individuals who purchase a retail box.

Retail boxes are generally sold in an assembled condition. A purchaser of a retail box will typically purchase a particular quantity of retail boxes, which remain on hand for use in shipping. As can be appreciated, a company that ships a large volume of retail items may require a large inventory of retail boxes to be on hand to meet the needs of shipping various retail items. Maintaining a large inventory of retail boxes can have disadvantages, such as the need to pay taxes on the maintained inventory and space requirements associated with storing the quantity of retail boxes. Additionally, standard retail boxes are damaged easily when impacted by crumbling or tearing.

Accordingly, it would be desirable to have a system and method for manufacturing retail boxes that combine the manufacture and opening and/or assembly of the boxes together in one process. Additionally, it would be desirable to have a system and method of making retail boxes that allows retail boxes to be manufactured at the point of use; therefore, reducing the quantity of retail boxes that need to be maintained as inventory or substantially eliminating the need to maintain an inventory of boxes, thereby making available resources to more productive activities. Additionally, it would be desirable to have a system and method for manufacturing retail boxes that produces boxes that are more resilient to impact, having glued flaps that are able to bend or recoil and fully recover from impacts. Additionally, it would be desirable to have a system and method for manufacturing retail boxes where the box is made from substrate that is inline printable, allowing custom printing to be performed during manufacture of the box, leading to faster time to market. Additionally, it would be desirable to have a system and method for manufacturing retail boxes where the box is made from a substrate that is substantially thinner than materials used to make current retail boxes, which is a desirable economic and ecological feature.

SUMMARY

The present disclosure is directed to a system and method for manufacturing retail boxes. The disclosed invention is operable to produce a retail box from paper, which is rolled on a core or provided in sheet form. Initially, a top and a bottom of the box are produced. For each of the top and bottom half of the box, a portion of paper that is output from paper rolled on a core or a sheet or a section of a sheet is applied.

In one embodiment, each of the top and the bottom halves are received in a folding plow, which folds the box portions into two complementary half-boxes. The two half-boxes are then brought together and glued at their respective sides. The overlapping box side portions are fully coated with glue when assembled, creating a strong composite structure. In one embodiment, tension is maintained on the assembled box structure and paper webbing in the direction of the webbing throughout the process and at least until the glue substantially cures. The assembled portion is now cut to length and at least one end portion of the box remains open allowing merchandise or other items to be placed in the interior of the box. Upon cutting to length, and before placing merchandise in the box, tension is applied to the assembled box in a direction substantially perpendicular to the direction of the previous tension and at a substantially right angle to the glued box side surface when the box is in an opened configuration. One of the ends may be optionally closed at this point by fully coating at least one surface of the end flaps and assembling the end flaps together. Merchandise or other items may then be placed in the box, and the remaining open box end may then be closed in a similar manner as the other end.

In another embodiment, the paper may be received in a rotary die cutting module. Here, the paper is cut into a desired shape and optionally scored and/or creased. The rotary die cutting module may cut portions of the paper webbing that will ultimately form the dust flaps, end flaps or sides of the box. After the top and bottom halves of the box have been cut and creased, the paper may then be fed into a folding plow.

In yet another embodiment, the paper webbing may be received by an inline printer. The inline printer may be used to print directly on the substrate at any point in the process.

These and other features of embodiments of the disclosure can be further understood from the following description, particularly when considered in connection with the accompanying drawings.

DETAILED DESCRIPTION

The present disclosure is directed to a retail box and a method of making a retail box. Retail boxes in accordance with the present disclosure are manufactured beginning with paper, which is rolled on a core, or alternatively is provided in sheet form. As used herein, a "retail box" refers to any box suitable for containing an item, for otherwise creating a desired volume, for creating a display, or for creating any other box-like structure. Two halves of the box, or "half-boxes," are first produced, and then brought together to form a complete box. In manufacturing a retail box from rolled or sheet paper, the present disclosure allows a retail box to be manufactured and assembled at the point of use. Specifically, a shipper or retailer who requires packaging for a particular item may keep rolled paper or sheets of paper on hand, and use the paper to manufacture a box when needed.

Figure 1:
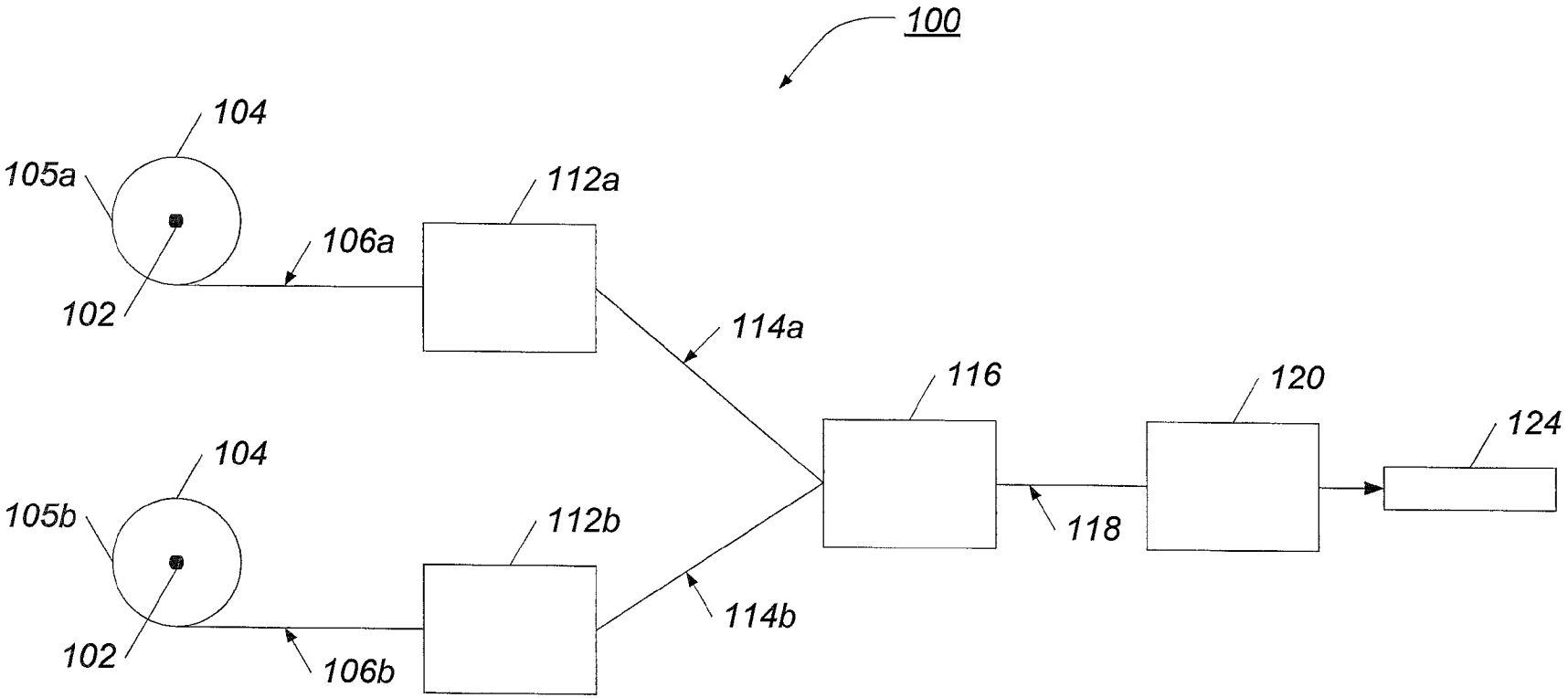
FIG. 1 is a diagram showing the manufacture and assembly of a retail box, in accordance with embodiments of the present disclosure.

With reference to FIG. 1, a system 100 for manufacturing a retail box in accordance with embodiments of the present disclosure is depicted. In manufacturing a retail box, the present disclosure begins with one or more supplies 104 of paper or other substrate 105 material that are each rolled onto a respective core 102. For the purposes of illustration, FIG. 1 includes two paper rolls 105*a* and 105*b* to supply paper for the two half-boxes that will be used to form a completed box. As can be appreciated by one of skill in the art, the present disclosure may be used in connection with one paper roll 105, which supplies paper or paper webbing 106 for both half-boxes. As an alternative to one or both rolls of paper 105, the paper supplies 104 may be in the form of individual sheets of paper. As a first step in manufacturing a retail box in accordance with embodiments of the present invention, paper 106 is dispensed from a paper roll 104 and received in a folding plow 112. The folding plow 112 receives the paper webbing 106 and creases and folds the paper 106, to form a half-box blank 114. The half box blank 114 is then sent to bonding or gluing station 116 where it is joined with another half box 114 to form an assembled box blank 118. The assembled box blank 118 then passes to cutting station 120, where the box is cut to length, producing a box 124. As can be appreciated, the width of the half-box may be determined by the width of the paper 104, as it is contained on the core 102. As shown in FIG. 1, two folding plows 112*a* and 112*b* may be provided to form half box blanks 114*a* and 114*b* from two supplies 104 of paper 106*a* and 106*b*.

In another embodiment of the present disclosure, a rotary die cutting module may accept the paper webbing 106 before transmitting the webbing to the folding plow 112. The rotary die cutting module receives the paper and cuts and creases the paper to produce creases in the webbing to better enable the folding plow 112 to create creased and folded paper 114. Additionally as one having skill in the art will appreciate, the rotary die cutting module is operable to produce creases and/or cuts in the paper webbing 106 in locations that may ultimately form the dust flaps, end flaps or sides of the box. As one having skill in the art will appreciate, removal of a certain amount of material, for example, on the dust flaps resulting in a tapered flap (e.g., trapezoidal), may ease later assembly of the end flaps and dust flaps.

Figure 2:
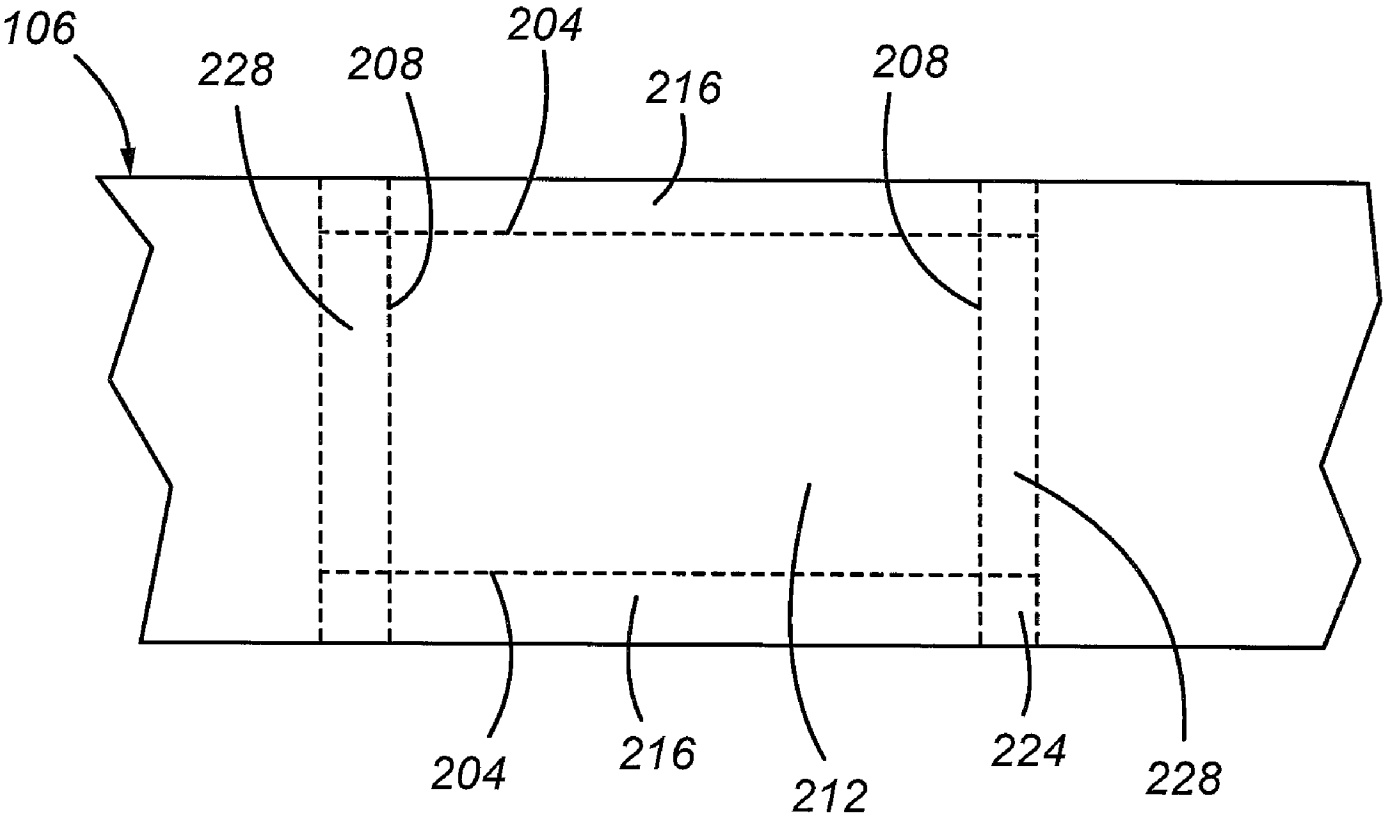
FIG. 2 shows a segment of paper webbing and score lines along which folds may be made.

FIG. 2 shows a segment of the paper webbing 106 and illustrates the portions of the webbing that will ultimately become features of a box. Score lines 204 and 208 represent lines along which the webbing will be folded to create a central section 212, the side flaps 216, the end flaps 228 and the dust flaps 224. As is shown, the section of webbing will become a half-box having a central section 212 and four flaps, including two side flaps 216 and two end flaps 228 that depend from the central section 212. One having skill in the art will appreciate that a dust flap 224 may be cut and configured to depend from either the side flaps 216 or the end flap 228. In one embodiment, score lines 204 and 208 may represent creases or score lines created by a rotary die module along which the folds will be created.

Figure 3A:
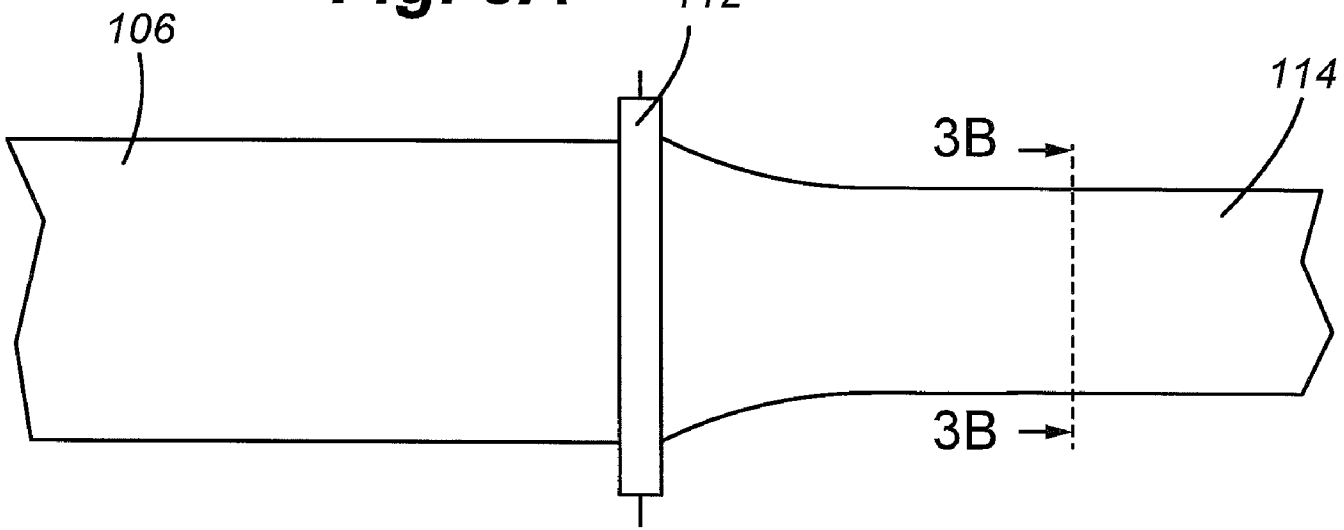
FIG. 3A shows paper webbing as it passes through a folding plow.
Figure 3B:
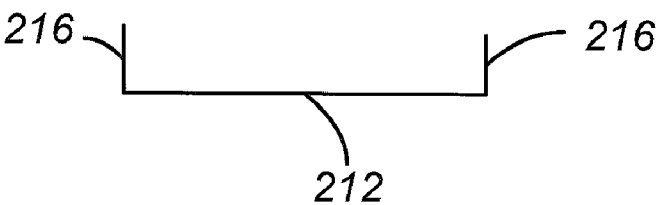
FIG. 3B shows a cross-sectional view of the paper webbing after it has passed through the paper plow.

FIG. 3A shows the paper webbing 106, before and after it passes through the folding plow 112, at which point it comprises a half-box blank 114. FIG. 3B is a cross-sectional view of the half-box blank 114 after it has passed through the folding plow 112. As shown, the half-box blank 114 generally has a U-shape, and having a central section 212 and two side flaps 216 depending from either side of central section 212. Prior to joining the two half-boxes, the side flaps 216 of each half-box blank 114 can be folded by the folding plow 112 so that the side flap 216 is approximately 90 degrees with respect to the central section 212, as shown in FIG. 3B.

After two half-box blanks 114 are produced, whether in series or in parallel, the two half-box blanks 114 are brought together at the gluing station 116. In accordance with embodiments of the present disclosure, the gluing station 116 includes a glue gun operable to dispense glue or some other bonding agent. In the gluing station 116, glue is dispensed to coat one side of a side flap 216, associated with one of the half-box blanks 114. This coated side flap 216 is then brought together or joined with a corresponding side flap 216 on the other half-box blank 114. Before bringing together the two corresponding side flaps 216 of the two half-boxes, glue or some other bonding agent may also be applied to the other side flap 216, so that both side flaps 216 have glue on at least one side of the flap, preferably the side that faces or comes into contact with the side flap 216 of the opposite half-box blank 114. The bonding agent (e.g., glue, epoxy, resin, cement or adhesive) may be applied to the side flap 216 in an engineered pattern coating, which is designed to provide support and bear load for the side flaps 216. The bonding agent is preferably spread over close to all, or substantially 100% of the side flap 216. A device other than, or in addition to, the glue gun may be used to achieve substantially 100% coverage including, for example, a sprayer, a roller, a nozzle, static, a glue roller and a flat edge (e.g., for evenly spreading the glue). The glue is preferably spread over a majority of one or both of the side flaps 216, and is more preferably close to or substantially 100% coverage. One having skill in the art will appreciate that the engineered pattern coating may be a grid-like coating or matrix pattern of bonding agent that is applied to one or both of the side flaps 216. One having skill in the art will also appreciate that a combination of a grid-like coating or matrix pattern and a smooth layer may be used to achieve the necessary strength in the bonding agent layer. The glue is preferably at a low viscosity during application to either or both side flaps 216. The glue is preferably elastic when dry, and is preferably a hot-melt glue with a relatively fast curing time. The hot melt glue preferably cures as its temperature drops. One having skill in the art will appreciate a preferable cure time based on the operational requirements of the box assembly system. One having skill in the art will also appreciate the methods used to accelerate curing of the glue including, for example, cooling the machinery at a point after the bonding agent is applied using liquid coolant (e.g., water), using compressed air, using solid-state coolers, applying ultraviolet (UV) radiation.

In bringing together two half-box blanks 114, the corresponding side flaps 216 are glued together. This produces a box having four closed sides and two open sides, the open sides including end flaps 228 and dust flaps 224 of each half-box. Moreover, the two side flaps 216 forming opposite sides of the box 124 are composite box side portions, each comprising one side flap 216 of one of the half-box blanks 114, bonded to one side flap 216 of the other one of the half box blanks 114.

It is one aspect of the present disclosure that the paper or other substrate 106, 114 is held in tension in the longitudinal direction through the processes of gluing the side flaps 216. The paper or other substrate 106, 114 is preferably held in tension until the glue substantially cures. Tension may be maintained in the paper or substrate 106, 114 in the longitudinal direction using conventional methods including, for example, web handling equipment from the moment the paper or substrate 106 comes off the rolls 104 through the folding plows 112 and the gluing station 116. After the glue has cured or substantially cured, the tension in the longitudinal direction may be released.

It is another aspect of the present disclosure that the assembled paper or substrate may be cut to length in cutting station 120. One having skill in the art will appreciate the methods by which the paper or other substrate 106 may be cut, including, for example a blade, press, knife, rotary saw, band saw, reciprocating blade, laser and water jet.

Figure 4:
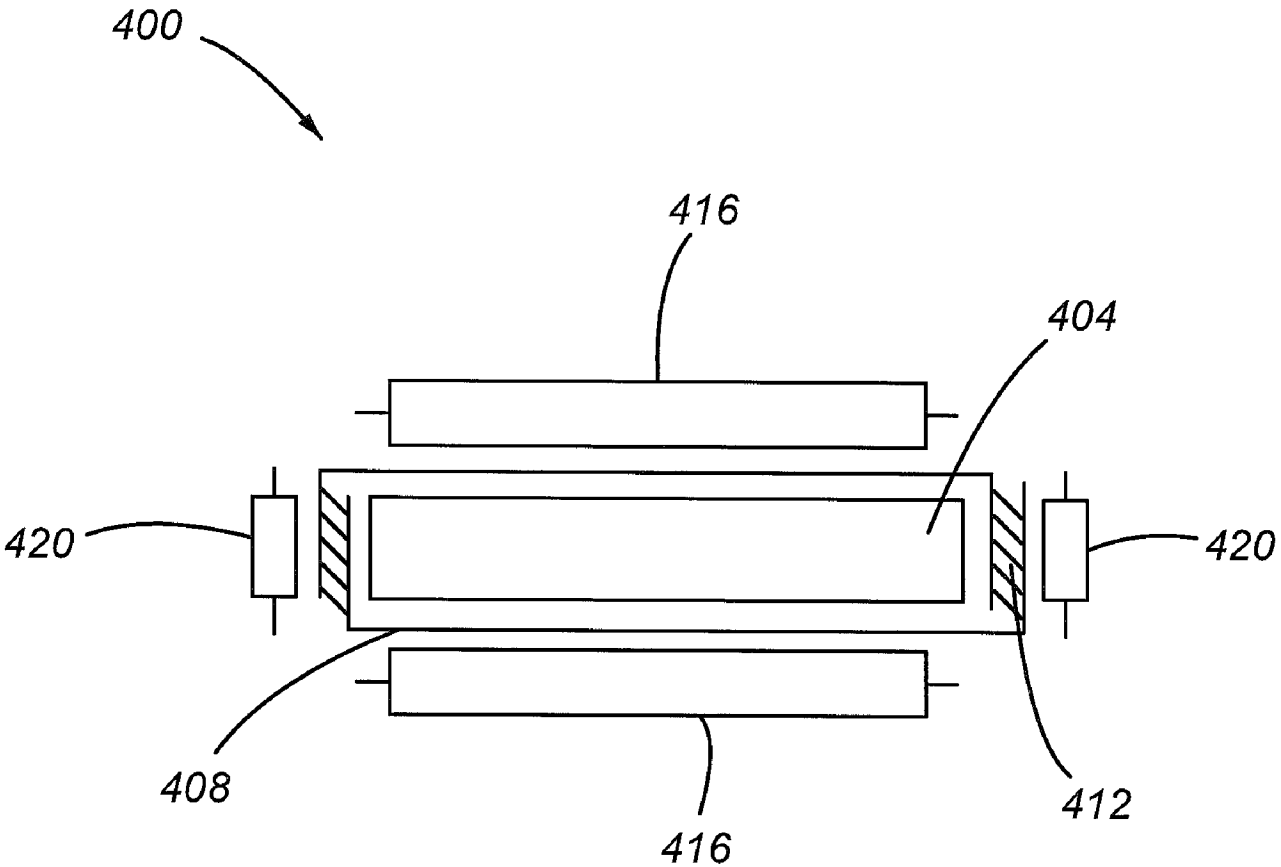
FIG. 4 shows an assembled box being engaged by rollers and a box guide.

FIG. 4 shows a cross sectional view 400 of a top half and a bottom half of the box 124 assembled with glue. As can be seen in FIG. 4, the top half of the box shows the side flaps 216 depending downward from the central section 212 that forms the top half of the box. The bottom half of the box shows the side flaps 216 depending upward from the central section 212.

FIG. 4 shows an embodiment in which a box structure 404 inside the assembled box. The box structure 404 is a guide upon which the half-box blanks 114 sit or are assembled to in the gluing station 116. The box structure 404 serves as a support that provides an opposing force to the top and bottom rollers 416 and side rollers 420. The box 124 is not glued to or otherwise permanently attached to the box structure 404, but the box structure 404 may be a stationary structure upon which the assembled box 124 slides as it is pulled by the rollers 416, 420. The force exerted on the assembled box 124 by the rollers 416, 420 provides tension to the webbing of the box 124 in the longitudinal direction during the gluing process. The side rollers 420 further serve to press the adjacent side flaps 216 together, causing the glue to spread evenly between the side flaps 216 and eliminate any voids that may be present. The figure shows the assembled box 124 having single-ply top and bottom sides and double-ply, composite side flaps 412. The attaching or gluing occurs on two side flaps 216 of the half-boxes, while the remaining two end flaps 228 and dust flaps 224 of the half-boxes are left unglued. Accordingly, an assembled box 124 is produced with an open front end and an open back end.

The side rollers 420 are shown with their axes substantially perpendicular to the longitudinal direction. In another embodiment of the present disclosure, the rollers may be rotated up to 90 degrees or oriented so that their axes are in a range between substantially perpendicular and substantially parallel to the longitudinal direction. The rotation or orientation of the side rollers 420 other than substantially perpendicular combined with the frictional force between the roller and substrate creates a tension in the side flap 216 in a direction other than longitudinal and in a direction that is oblique to the tension in the adjacent side flap 216.

Figure 5:
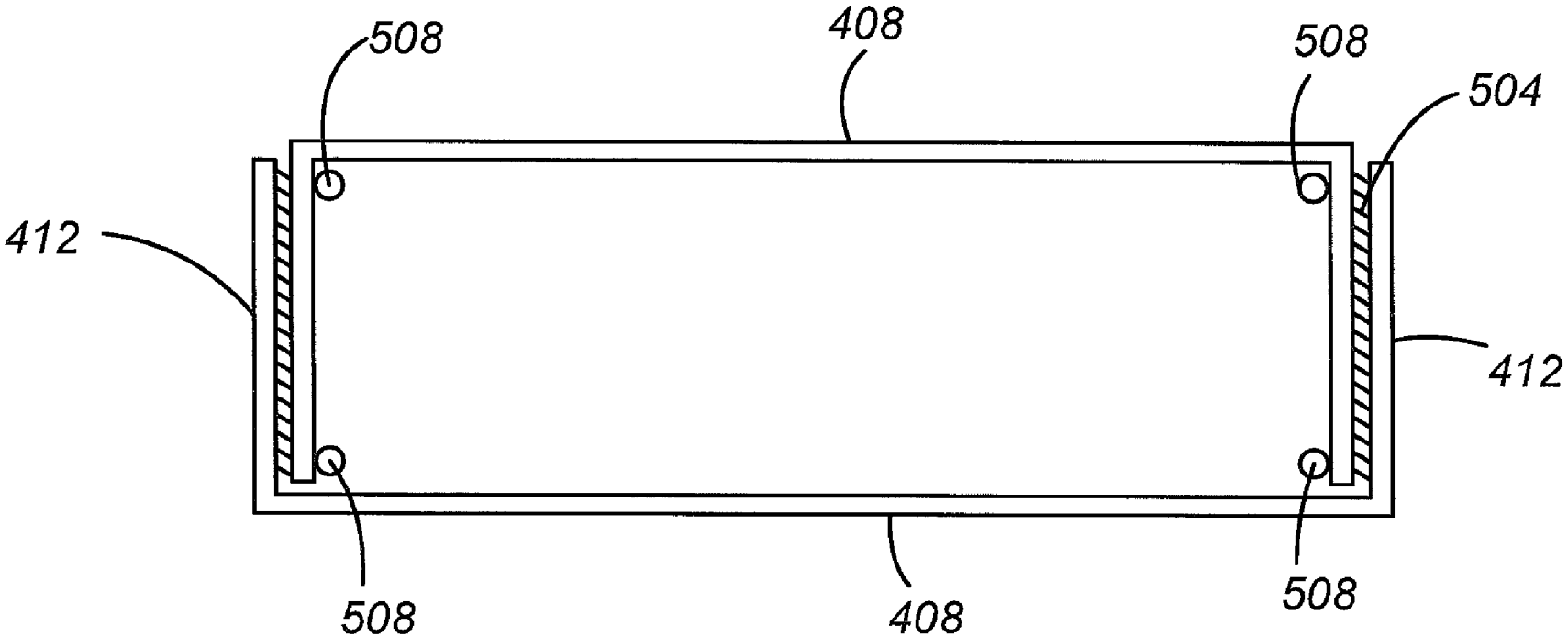
FIG. 5 shows a cross-sectional view of an assembled box being engaged by tensioning prongs.

FIG. 5 shows a cross-sectional view of an assembled box 124. The figure illustrates the composite side flaps 412 of the box having overlapping side flaps 216, and having substantially 100% coverage of bonding agent 504 between the respective side flaps 216, to form the composite, double-ply side flaps 412 of the box 124. The figure also illustrates that in the final box 124 configuration, the composite, double-ply side flap 412 has a thickness that is more than twice that of the thickness of a single side flap 216. The figure shows the box 124 having prongs or pins 508 located at the corners of the box 124. Before, during or after the assembled paper or substrate is cut to length in process 120, these prongs 508 are inserted into the hollow cavity on the inside of the box 124, and force is applied by the prongs 508 to provide tension around a periphery of the assembled box 124. For example, the applied force may be in a direction that is perpendicular to the creases defining the side flaps 216. One having skill in the art will appreciate the prongs 508 could be configured as four pins, two thin bars or a combination thereof that can slide in and out of the box corners without damaging the box.

Figure 6:
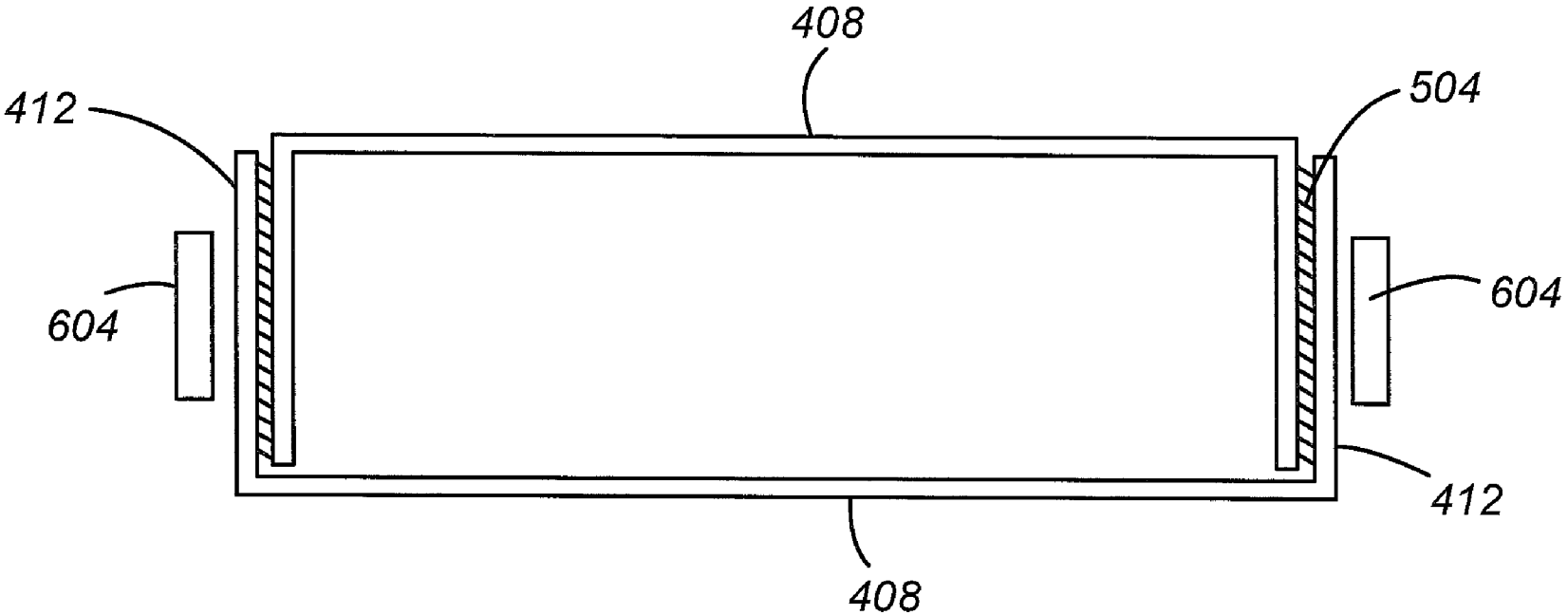
FIG. 6 shows a cross-sectional view of an assembled box being engaged by vacuum plates.

In an alternative embodiment, vacuum plates can be used to grasp (using a vacuum) the composite side flaps 412 of the box to provide perpendicular tension. FIG. 6 is a cross sectional view of an assembled box and illustrates how vacuum plates 604 can be assembled to the composite side flaps 412 of the box to provide the desired tension to the box.

Figure 7A:
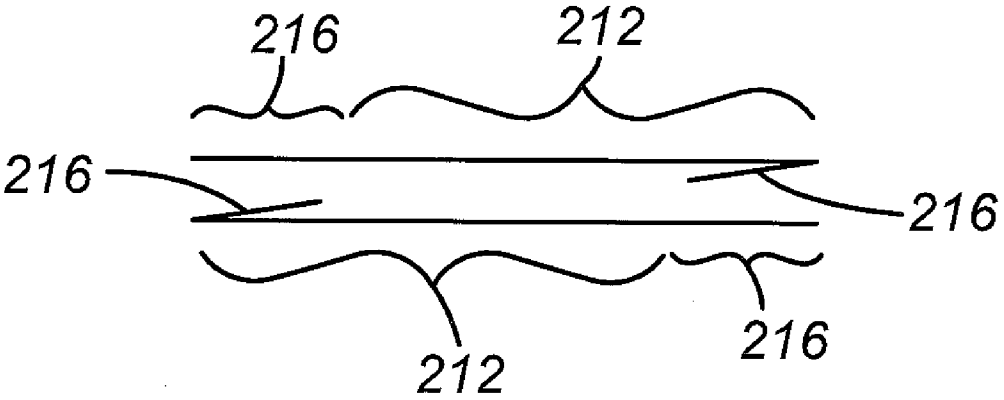
FIGS. 7A & B show a cross-sectional view of the assembly of two half-boxes in an alternate embodiment.

FIG. 7A, shows a cross sectional view of two halves of a box. Each half, an upper half and a lower half, has a central section 212 and two side flaps 216 that comprise the longitudinal sides of the box. In this embodiment of the present disclosure, only one of the side flaps 216 of a half-box blank 114 is folded over. As shown in the figure, one of the side flaps 216 of the top half-box blank 114 is folded over and one of the side flaps 216 of the bottom half-box blank 114 is folded over. The side flap 216 that is folded over is selected so that when the two halves are assembled, the folded over side flaps 216 are opposite each other. As described above, the upper and lower half-box blanks 114 are assembled in the gluing station 116, where glue or another bonding agent is applied as an engineered pattern coating on the surface of one or both opposing surfaces of the side flaps 216. As also described above, the two half-box blanks 114 are then brought together, and force is applied to bind the two halves together at the portions where glue has been applied. One having skill in the art will appreciate the methods that may be used to apply said force including, for example, a press, a roller disposed on either side of the flat box (either above or below), or more preferably two rollers disposed on both sides of the flat box (both above and below).

Figure 7B:
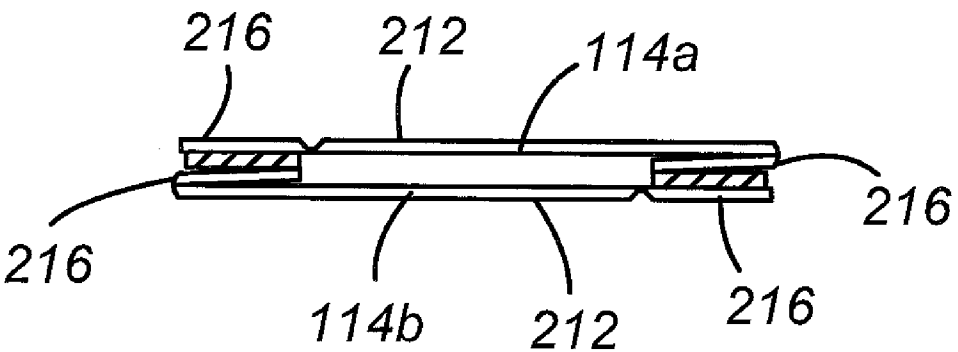

The result when the two halves 114 are assembled, as shown in FIG. 7B is a flat box assembly where at least one side flap 216 of a half-box blank 114 is substantially coplanar with the central section 212. As one having skill in the art will appreciate, the configuration illustrated in FIGS. 7A & B may be preferable for applications where the box does not immediately receive an item, and the assembled box is intended to be stored in a flat configuration for later expansion and use.

Figure 8:
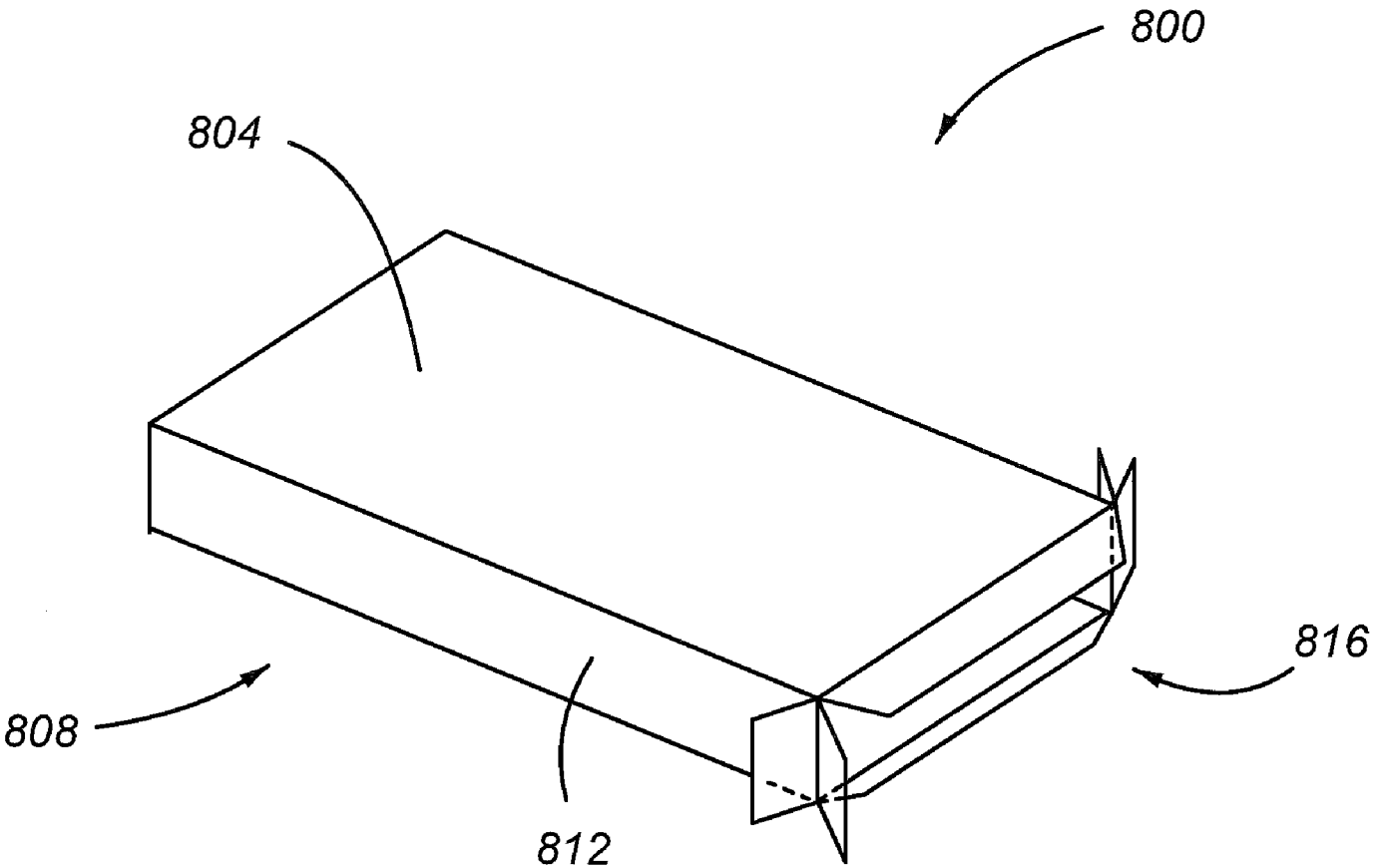
FIG. 8 shows an illustration of an assembled box.

In FIG. 8, an assembled box 800, in accordance with embodiments of the present disclosure is shown. The assembled box 800 includes a top side 804 and a bottom side 808. As can be appreciated from the discussion above, the top side 804 and the bottom side 808 are single ply sides. The remaining four sides of the box 800 are double ply sides. It will be understood that the open ends 816 will be double-ply upon closure. In particular, the box 800 includes two double-ply sides 812, one of which is visible in FIG. 8. Additionally, the box 800 includes two open ends 816, one of which is visible in FIG. 8. The sides 812 are closed by the gluing process described above. In accordance with embodiments of the present disclosure, the open ends 816 remain open and operable to receive items therethrough into the interior of the box 800. After items are received by or inserted into the box 800 through either of the two open ends 816, one or both of the open ends 816 of the box 800 may be closed and box may then be shipped, stored, etc., as needed. In another embodiment of the present disclosure, one of the open ends 816 is closed before or substantially at the same time the box 800 receives items or payload. Thereafter, the remaining open end 816 may be closed, and the box 800 and item assembly is then ready to be shipped, stored, etc., as needed. An end flap 228 of a half-box may be closed or assembled to a corresponding end flap 228 of a corresponding half-box using a glue gun operable to dispense glue. Once glue is applied to one or both facing sides of end flaps 228 (i.e., sides that are facing upon assembly), the flaps are brought together to bond them. The glue is preferably spread over close to all, or substantially 100% of the end flap 228. A device other than, or in addition to, the glue gun may be used to achieve substantially 100% coverage including, for example, a sprayer, a roller, a glue roller and a flat edge (e.g., for evenly spreading the glue).

In one embodiment of the present disclosure, the dust flaps 224 at a corner may both depend from the end flaps 228. In another embodiment, one dust flap 224 may depend from one of the end flaps 228, and the other dust flap 224 may depend from one of the side flaps 216. In yet another embodiment, the dust flaps 224 at a corner may both depend from the side flaps 216.

It is another aspect of the present disclosure that both dust flaps 224 at a corner of the box may be glued to the end flaps 228. Specifically, glue may be applied to the dust flaps 224 with a glue gun, and the dust flaps 224 are then brought together with an end flap 228 and/or each other to effect assembly of the dust flap 224. Having the dust flaps 224 glued to the corners provides substantial strength to the box, and improves the strength at the corners as the corners absorb impacts and bear much of the load of the box. One having skill in the art will appreciate that this aspect of the present disclosure creates a four-ply portion on the end flap 228 where the dust flaps 224 are glued to the end flaps 228. In one embodiment, the dust flaps 224 at a corner may both depend from the side flaps 216.

It is another aspect of the present disclosure that both dust flaps 224 at a corner of the box may be glued to the side flaps 216. Glue may be applied to the dust flaps 224 with a glue gun, and the dust flaps 224 are then brought together with a side flap 216 and/or each other to effect assembly of the dust flap 224. One having skill in the art will appreciate that this aspect of the present disclosure creates a four-ply portion on the side flap 216 where the dust flaps 224 are glued to the side flap 216.

It is yet another aspect of the present disclosure that one dust flap 224 at a corner can be glued to an end flap 228, while a second dust flap 224 at the same corner can be glued to a side flap 216. Glue may be applied to the dust flaps 224 with a glue gun, and one dust flap 224 is then brought together with an end flap 228, while the other dust flap 224 is then brought together with a side flap 216 to effect attachment of the dust flaps 224. One having skill in the art will appreciate that this aspect of the present disclosure creates two adjacent three-ply portions. One three-ply portion is on the side flap 216 where one dust flap 224 is glued to the side flap 216, and the other three-ply portion is on the end flap 228 where second dust flap 224 is glued to the end flap 228.

It is still yet another aspect of the present disclosure that only one dust flap 224 at a corner is glued to either an end flap 228 or a side flap 216. Glue may be applied to the dust flap 224 with a glue gun, and the dust flap 224 is then brought together with one of an end flap 228 or a side flap 216 to effect assembly of the dust flap 224. One having skill in the art will appreciate that this aspect of the present disclosure creates one three-ply portion. The three-ply portion is on the side flap 216 or the end flap 228 where the dust flap 224 is glued to the corresponding side or end flap.

In the foregoing descriptions of dust flap 224 assembly, the glue applied to the dust flap 224 is preferably spread over close to all, or substantially 100% of the surface of the dust flap 224 that is to be bonded to the other dust flap 224, end flap 228 or side flap 216, and a device other than, or in addition to, the glue gun may be used to achieve substantially 100% coverage including, for example, a sprayer, a roller, a glue roller and a flat edge (e.g., for evenly spreading the glue).

In accordance with embodiments of the present disclosure, any suitable type paper may be used to manufacture a box in accordance with the disclosure. For example, size 7-8 Manila paper may be used. Additionally, paper that is less than 40 mils thick may be used to produce a box in accordance with embodiments of the present disclosure. The paper is preferably of a porous construction as this is more effective for bonding. Moreover, embodiments of the present disclosure do not require paper taken from paper rolls. In particular, sheets of pre-cut paper may be used to form each half-box.

In accordance with other embodiments of the present disclosure, the paper could be replaced by a film including, for example, PE, PET, PVC, PEEK or other polymer based films. It will be appreciated that when a non-fibrous or paper substrate is used, other chemical means may be used to bond the various sides, flaps, portions to other sides, flaps and portions. Additionally, techniques including, for example, ultrasonic welding may be used to bond the various sides, flaps, portions to other sides, flaps and portions.

In accordance with embodiments of the present disclosure, a printer may be used to print graphics, labels and/or other printed material on the continuous sheet of paper prior to the paper being cut, creased, folded, and otherwise processed by the various machine steps of the disclosure. The paper having a printed graphic may then be indexed prior to being cut, creased, folded, and otherwise processed by the various machine steps of the disclosure. One having skill in the art will appreciate that a printer may be inserted in the manufacture process at various points in the process including between the paper rolls 104 and the folding plow 112, between the folding plow 112 and the gluing station 116, between the gluing station 116 and the cutting station 120, and after the cutting station 120. A printer may also be integrated with another component, such as with a folding plow 112. One having skill in the art will appreciate that the aspect of the present disclosure that permits the use of a thin substrate permits flexibility in positioning the inline printer. Printer is meant to include single-pass or multi-pass single or multi-color apparatus, and may also include devices that apply engraving, carving, branding, stamping, embossing and watermark imprinting.

Retail boxes made in accordance with embodiments of the present disclosure are strong due to the presence of four double ply sides. The result of the two composite, double-ply sides 412 having substantially complete-coverage glue, is that its resulting composite wall strength of the box is more than the aggregate of the components. This allows boxes to be manufactured from thinner paper and/or other materials than is possible with conventional methods. Conventional methods use thicker substrates including paper, board, paperboard, corrugated fiberboard and containerboard. Accordingly, less material is used to make a box of the present disclosure than a conventional box of equivalent or greater strength. This leads to a less wasteful and more environmentally friendly product. In addition, the corners of the assembled box may feature three or four ply portions, to provide sealing and increased strength at the corners of the box. Although sometimes referred to herein as a retail box, a box created by a method or apparatus in accordance with embodiments of the present invention is not restricted to any particular application or use.

The foregoing discussion of the disclosure has been presented for purposes of illustration and description. Further, the description is not intended to limit the invention to the form disclosed herein. Consequently, variations and modifications commensurate with the above teachings within the skill or knowledge of the relevant art are within the scope of the present disclosure. The embodiments described herein above are further intended to explain the best mode presently known of practicing the disclosure and to enable others skilled in the art to utilize the invention in such or in other embodiments and with the various modifications required by the particular application or use of the invention. It is intended that the appended claims be construed to include alternative embodiments to the extent permitted by the prior art.

What is claimed is:

1. A method of manufacturing a box, comprising:

providing a first pliable substrate;

folding the first pliable substrate along two lines to create two box side portions depending from a top half portion;

providing a second pliable substrate;

folding the second pliable substrate along two lines to create two box side portions depending from a bottom half portion;

applying a bonding agent to at least one of the first pliable substrate and the second pliable substrate, wherein the bonding agent is applied to at least some of a surface of the at least one of the first pliable substrate and the second pliable substrate corresponding to at least one box side portion;

maintaining the top half portion and the bottom half portion in tension;

attaching a first one of the two box side portions depending from the top half portion to a first one of the two box side portions depending from the bottom half portion, and attaching a second one of the two box side portions depending from the top half portion to a second one of the two box side portions depending from the bottom half portion, creating an assembled box blank with composite box side portions;

cutting the assembled box blank to a length to form a box, wherein a first end and a second end of the box are open;

cutting the first pliable substrate along at least first and second lines, wherein at least a first pair of cuts are formed in the first pliable substrate;

folding a first portion of the first pliable substrate adjacent the at least a first pair of cuts, wherein a first end flap depending from the top half portion and two dust flaps are formed;

cutting the second pliable substrate along at least first and second lines, wherein at least a first pair of cuts are formed in the second pliable substrate;

folding a first portion of the second pliable substrate adjacent the at least a first pair of cuts, wherein a first end flap depending from the bottom half portion and two dust flaps are formed;

cutting the first pliable substrate along at least third and fourth lines, wherein at least a second pair of cuts are formed in the first pliable substrate;

folding a second portion of the first pliable substrate adjacent the at least a second pair of cuts, wherein a second end flap depending from the top half portion and two dust flaps are formed;

cutting the second pliable substrate along at least third and fourth lines, wherein at least a second pair of cuts are formed in the second pliable substrate;

folding a second portion of the second pliable substrate adjacent the second pair of cuts, wherein a second end flap depending from the bottom half portion and two dust flaps are formed.

2. The method of claim 1, further comprising:

applying the bonding agent to at least two end flaps;

attaching at least portions of the first end flap depending from the top half portion to at least portions of the first end flap depending from the bottom half portion;

attaching at least portions of the second end flap depending from the top half portion to at least portions of the second end flap depending from the bottom half portion.

3. The method of claim 2, further comprising:

before at least one of attaching at least portions of the first end flap depending from the top half portion to at least portions of the first end flap depending from the bottom half portion and attaching at least portions of the second end flap depending from the top half portion to at least portions of the second end flap depending from the bottom half portion, placing an item in the box.

4. The method of claim 2, further comprising:

adhering dust flaps provided as part of the first substrate to a portion of the second substrate, wherein the end flaps are adjacent corners of the box, and wherein at least one of a side wall and an end wall of the box has at least a three ply construction.

5. The method of claim 2, wherein at least one of a side wall and an end wall of the box has a four ply portion.

6. The method of claim 2, wherein the bonding agent applied to the at least one box side portion is a first bonding agent, and wherein the bonding agent applies the at least two end flaps is a second bonding agent.

7. A method of manufacturing a box, comprising:

providing a first pliable substrate;

folding the first pliable substrate along two lines to create two box side portions depending from a top half portion;

providing a second pliable substrate;

folding the second pliable substrate along two lines to create two box side portions depending from a bottom half portion;

applying a bonding agent to at least one of the first pliable substrate and the second pliable substrate, wherein the bonding agent is applied to at least some of a surface of the at least one of the first pliable substrate and the second pliable substrate corresponding to at least one box side portion;

maintaining the top half portion and the bottom half portion in tension;

attaching a first one of the two box side portions depending from the top half portion to a first one of the two box side portions depending from the bottom half portion, and attaching a second one of the two box side portions depending from the top half portion to a second one of the two box side portions depending from the bottom half portion, creating an assembled box blank with composite box side portions;

cutting the assembled box blank to a length to form a box, wherein a first end and a second end of the box are open, wherein the bonding agent is applied as a pattern coating.

8. The method of claim 7, further comprising:

cutting the first pliable substrate along at least first and second lines, wherein at least a first pair of cuts are formed in the first pliable substrate;

folding a first portion of the first pliable substrate adjacent the at least a first pair of cuts, wherein a first end flap depending from the top half portion and two dust flaps are formed;

cutting the second pliable substrate along at least first and second lines, wherein at least a first pair of cuts are formed in the second pliable substrate;

folding a first portion of the second pliable substrate adjacent the at least a first pair of cuts, wherein a first end flap depending from the bottom half portion and two dust flaps are formed;

applying the bonding agent to at least two end flaps;

attaching at least portions of the first end flap depending from the top half portion to at least portions of the first end flap depending from the bottom half portion;

attaching at least portions of the second end flap depending from the top half portion to at least portions of the second end flap depending from the bottom half portion;

attaching at least portions of the two dust flaps of the first pliable substrate to adjacent portions of at least one of the first pliable substrate and the second pliable substrate;

attaching at least portions of the two dust flaps of the second pliable substrate to adjacent portions of at least one of the first pliable substrate and the second pliable substrate, wherein attaching includes interconnecting using the bonding agent.

9. A method of manufacturing a box, comprising:

providing a first pliable substrate;

folding the first pliable substrate along two lines to create two box side portions depending from a top half portion;

providing a second pliable substrate;

folding the second pliable substrate along two lines to create two box side portions depending from a bottom half portion;

applying a bonding agent to at least one of the first pliable substrate and the second pliable substrate, wherein the bonding agent is applied to at least some of a surface of the at least one of the first pliable substrate and the second pliable substrate corresponding to at least one box side portion;

maintaining the top half portion and the bottom half portion in tension;

attaching a first one of the two box side portions depending from the top half portion to a first one of the two box side portions depending from the bottom half portion, and attaching a second one of the two box side portions depending from the top half portion to a second one of the two box side portions depending from the bottom half portion, creating an assembled box blank with composite box side portions, wherein the tension is maintained in a longitudinal direction, at least until after the top half portion and the bottom half portion of the box are attached to form the assembled box blank;

cutting the assembled box blank to a length to form a box, wherein a first end and a second end of the box are open.

10. The method of claim 9, wherein substantially all of the surface of the at least one of the first substrate and the second substrate corresponding to at least one box side portion is coated with the bonding agent.

11. The method of claim 9, further comprising:

maintaining, while drawing the assembled box blank in the longitudinal direction, tension in a substantially perpendicular direction to the direction of drawing, wherein the direction of drawing is substantially parallel with at least part of the box top half portion and the box bottom half portion, wherein the maintaining tension in a substantially perpendicular direction comprises:

inserting, prongs into the hollow cavity of the box, wherein the prongs are configured to maintain the shape of the box; and applying, by the prongs, tension to the box.

12. The method of claim 9, further comprising:

maintaining, while drawing the assembled box blank in the longitudinal direction, tension in a substantially perpendicular direction to the direction of drawing, wherein the direction of drawing is substantially parallel with at least part of the box top half portion and the box bottom half portion, wherein the maintaining tension in a substantially perpendicular direction comprises:

assembling a first vacuum plate to the outside surface of either of the two box side portions;

assembling a second vacuum plate to the outside surface of the other of the two box side portions;

applying a vacuum between the assembled first vacuum plate and the box side portion, and between the assembled second vacuum plate and the other box side portion;

applying, by the vacuum plates, tension to the assembled box blank.

13. The method of claim 9, wherein the two lines along which the first substrate is folded are substantially parallel to one another, and wherein the two lines along which the second substrate is folded, are substantially parallel to one another.

14. The method of claim 9, wherein providing the first substrate comprises:

receiving a continuous sheet of paper from a paper roll.

15. The method of claim 14, wherein prior to folding the first substrate feed, further comprising:

printing a graphic on the continuous sheet of paper; and indexing the continuous sheet of paper.

16. The method of claim 14, wherein the continuous sheet of paper is less than 40 mils thick.

17. The method of claim 9, further comprising:

placing an item through either the open first end or the open second end and into a hollow cavity of the assembled box blank;

closing the first end; and closing the second end.

18. The method of claim 9, further comprising:

drawing the assembled box blank over a rigid guide, wherein the assembled box blank has an inside hollow cavity and an outside surface, and wherein the rigid guide is configured to occupy substantially all of the inside hollow cavity of the assembled box blank.

19. The method of claim 9, further comprising:

cutting the first substrate along at least first and second lines, which at least a first pair of cuts are formed in the first substrate;

first folding a first portion of the first substrate adjacent the at least a first pair of cuts, wherein a first end flap depending from the top half portion and two dust flaps are formed.

20. The method of claim 19, further comprising:

cutting the second substrate along at least first and second lines, wherein at least a first pair of cuts are formed in the second substrate;

folding a first portion of the second substrate adjacent the at least a first pair of cuts, wherein a first end flap depending from the bottom half portion and two dust flaps are formed.

* * * * *